United States Patent [19]

Frye

[11] 4,346,881

[45] Aug. 31, 1982

[54] METHOD OF AND MEANS FOR HANDLING PAPER SHEETS TO BE STACKED

[75] Inventor: Kenneth G. Frye, Lee, Mass.

[73] Assignee: Lenox Machine Company, Inc., Lenox, Mass.

[21] Appl. No.: 232,170

[22] Filed: Feb. 6, 1981

Related U.S. Application Data

[63] Continuation of Ser. No. 29,397, Apr. 12, 1979, abandoned.

[51] Int. Cl.[3] ..... B65H 9/14; B65H 29/12

[52] U.S. Cl. ..... 271/208; 271/202; 271/188; 493/465

[58] Field of Search ..... 271/202, 203, 208, 182, 271/188, 209, 195; 83/88, 176; 493/465, 463

[56] References Cited

U.S. PATENT DOCUMENTS

| | | | |
|---|---|---|---|
| 1,010,520 | 12/1911 | Pringle . | |
| 2,101,328 | 12/1937 | Broadmeyer | 271/188 |
| 2,261,972 | 11/1941 | Matthews | 271/195 |
| 2,843,377 | 7/1958 | Battersby | 271/188 |
| 3,178,174 | 4/1965 | Schneider | 271/202 |
| 3,198,046 | 8/1965 | De Angelo . | |
| 3,351,215 | 11/1967 | Kitch . | |
| 3,380,734 | 4/1968 | Laumer | 271/195 |
| 3,438,295 | 4/1969 | Heinz et al. . | |

*Primary Examiner*—Robert B. Reeves
*Assistant Examiner*—Brian Bond
*Attorney, Agent, or Firm*—Hill, Van Santen, Steadman, Chiara & Simpson

[57] ABSTRACT

Paper sheets are advanced seriatim between high speed upper and lower conveyor belts across a gap onto a slower speed multi-belt conveyor with which the upper high speed belts cooperate to form a sheet controlling tunnel. Static eliminating and sheet knock-down air is directed through the upper high speed belts and into the sheets traversing the gap. Advance of the sheets across the gap is facilitated by impermanent wave-like longitudinal stiffening rib deflection of the sheets where they leave the high speed conveyor belts. After each sheet has been fully received on the slow speed conveyor, its high speed travel is stopped by stop roll means to assure overlap of a succeeding sheet thereon. The stop roll means cooperate with the slower speed conveyor belts to effect impermanent wave-like longitudinal jam preventing stiffening rib deflection of the sheets.

17 Claims, 4 Drawing Figures

METHOD OF AND MEANS FOR HANDLING PAPER SHEETS TO BE STACKED

This is a continuation, of application Ser. No. 029,397, filed Apr. 12, 1979, now abandoned.

This invention relates to method of and means for handling paper sheets to be stacked, and is more particularly concerned with controlling paper sheets efficiently at relatively high speed as delivered from high speed conveyor means to slower speed overlap controlling conveyor means.

As paper sheets or clips are advanced from means which shear the clips or sheets from a continuous paper web to a stacker, various problems are encountered, among which may be mentioned tendency of the sheets to cling to the conveying means due to static electricity, turning up of the leading ends and/or the trailing ends of the sheets tending to cause jamming in the handling apparatus, and laminar air interference with movement of the sheets from one conveyor to the other conveyor in the handling apparatus. Conventional means attempting to solve these problems have been numerous and varied, such as lifting the edges of the clips or sheets thus forming a tunnel effect to afford stiffness to the clips or sheets. Knock-down cams or fingers have been used, vacuum under the sheets has been employed, and air blowing up has been employed.

An early example of a stacker employing corrugating rolls for stiffening the successive sheets, and knock-down fingers for pushing the successive sheets down into stacking relation is found in U.S. Pat. No. 1,010,520.

Another, later example of a similar arrangement is found in U.S. Pat. No. 3,351,215 utilizing a push-down blade or bar.

A sheet handling device in which successive sheets are underlapped by blowing air under the trailing end of the preceding sheet to receive the advancing end of a succeeding sheet between the trailing end and a conveyor is found in U.S. Pat. No. 3,198,046.

An interesting arrangement utilizing air to prevent hangup of the leading end of a paper web on a shearing bar is found in U.S. Pat. No. 3,438,295.

However, none of the foregoing patents nor available commercial expedients solve all of the principal problems encountered in handling paper sheets, and especially lightweight paper sheets at high speeds. In some instances, too much air under the sheet prevents the sheet from dropping towards stacking position with high speed efficiency. Static electricity causing sheets to stick to conveyor tapes has presented a problem which is often attacked by equipping the apparatus with elaborate and costly anti-static expedients. The sheets may tend to buckle with down curling effect or an up curling effect at the stop roll so that speed of operation is limited on pain of experiencing jamming.

An important object of the present invention is to provide a new and improved method of and means for handling paper sheets to be stacked and which will overcome the disadvantages, drawbacks, inefficiencies, shortcomings and problems inherent in prior arrangements.

Another object of the invention is to provide new and improved simple and efficient means for eliminating static electricity interference with high speed efficient handling of paper sheets to be stacked.

A further object of the invention is to provide new and improved method of and means for facilitating superimposed overlapping of paper sheets being handled for stacking.

Still another object of the invention is to provide new and improved method of and means for assuring jam-free handling of paper sheets to be stacked.

Within the principles of the invention, there is provided a method of handling paper sheets to be stacked, comprising advancing the sheets seriatim gripped between upper and lower corunning high speed conveyor belts in which said lower belts leave the advancing ends of the sheets at a predetermined point while said upper high speed conveyor belts extend a substantial distance beyond said point into sheet controlling tunnel relation over a slower speed multi-belt conveyor, on which the sheets are received for slowdown and stacking purposes, propelling the sheets across a gap from said lower high speed conveyor belts toward and onto said slower speed conveyor, directing ionized air downwardly through said upper high speed conveyor belts at said gap and downwardly onto the paper sheets traversing said gap and thereby eliminating static electricity attraction between the paper sheets and said upper conveyor belts and also pushing the paper sheets downwardly away from said upper conveyor belts whereby to assure freedom from interference between the trailing end of each sheet as it is delivered to the slower speed conveyor and the leading end of the next succeeding sheet, and as each successive sheet is fully received on said slower speed conveyor stopping high speed advance of the sheet and causing the sheet to travel with the slower speed conveyor so as to receive from said high speed conveyor belts a succeeding sheet in superimposed overlapping relation for slowdown and stacking purposes.

Also within the principles of the invention, there is provided a method of handling paper sheets to be stacked, comprising advancing the sheets seriatim gripped between upper and lower corunning high speed conveyor belts in which said lower belts leave the advancing ends of the sheet at a predetermined point while said upper high speed conveyor belts extend a substantial distance beyond said point into sheet controlling tunnel relation over a slower speed multi-belt conveyor on which the sheets are received for slowdown and stacking purposes, propelling the sheets across a gap from said lower high speed conveyor belts toward and onto said slower speed conveyor, effecting impermanent wave-like longitudinal stiffening rib deflection of the sheets before they enter said gap, whereby to facilitate advance of the leading ends of the sheets across said gap in a stable and sag resistant manner at least beyond the point of overlap with respect to the trailing ends of the next preceding sheets on said slower speed conveyor, directing air downwardly through said upper high speed conveyor belts at said gap and downwardly onto the sheets traversing said gap and pushing the trailing ends of the paper sheets after release from said upper conveyor belts downwardly relative to said dropoff point whereby to assure freedom from interference between the trailing end of each sheet as it is delivered to the slower speed conveyor and the leading end of the next succeeding sheet.

Apparatus for handling paper sheets to be stacked, comprising upper and lower corunning high speed conveyor belts for advancing the sheets seriatim gripped between said belts, said lower belts advancing with the sheets to a predetermined dropoff point, a slower speed multi-belt conveyor extending in sheet receiving but gap relation from said dropoff point, and on which the sheets are received for slowdown and stacking purposes, said upper high speed conveyor belts extending beyond said dropoff point and into sheet controlling tunnel relation over said slower speed conveyor, means for directing ionized air downwardly through said extending upper high speed conveyor belts at said gap and downwardly onto the paper sheets traversing said gap from said dropoff point toward and onto said slower speed conveyor and thereby eliminating static electricity attraction between the paper sheets and said upper conveyor belts and also pushing the paper sheets downwardly away from said upper conveyor belts to assure freedom from interference between the trailing end of each sheet as it is delivered to the slower speed conveyor and the leading end of the next succeeding sheet, and means for stopping high speed advance of each successive sheet as it is fully received on said slower speed conveyor and for causing such sheet to travel with the slower speed conveyor so as to receive thereon from said high speed conveyor belts a succeeding sheet in superimposed overlapping relation for slowdown and stacking purposes.

There is also provided apparatus for handling paper sheets to be stacked and comprising upper and lower corunning high speed conveyor belts for advancing the sheets seriatim gripped between said belts, said lower belts advancing with the sheets to a predetermined dropoff point, a slower speed multi-belt conveyor extending in sheet receiving but gap relation from said dropoff point, and on which the sheet are received for slowdown and stacking purposes, said upper high speed conveyor belts extending beyond said dropoff point and into sheet controlling tunnel relation over said slower speed conveyor, means for effecting impermenent wavelike longitudinal stiffening rib deflection of the sheets before they enter said gap, whereby to facilitate advance of the leading ends of the sheets across said gap in a stable and sag resistant manner at least beyond the point of overlap with respect to the trailing ends of the next preceding sheets on said slower speed conveyor, means for directing air downwardly through said upper high speed conveyor belts at said gap and downwardly onto the sheets traversing said gap for pushing the trailing ends of the paper sheets after release from said upper conveyor belts downwardly relative to said dropoff point to assure freedom from interference between the trailing end of each sheet as it is delivered to the slower speed conveyor and the leading end of the next succeeding sheet.

Other objects, features and advantages of the invention will be readily apparent from the following description of a certain representative embodiment thereof, taken in conjunction with the accompanying drawing although variations and modifications may be effected without departing from the spirit and scope of the novel concepts embodied in the disclosure and in which.

Figure 1:
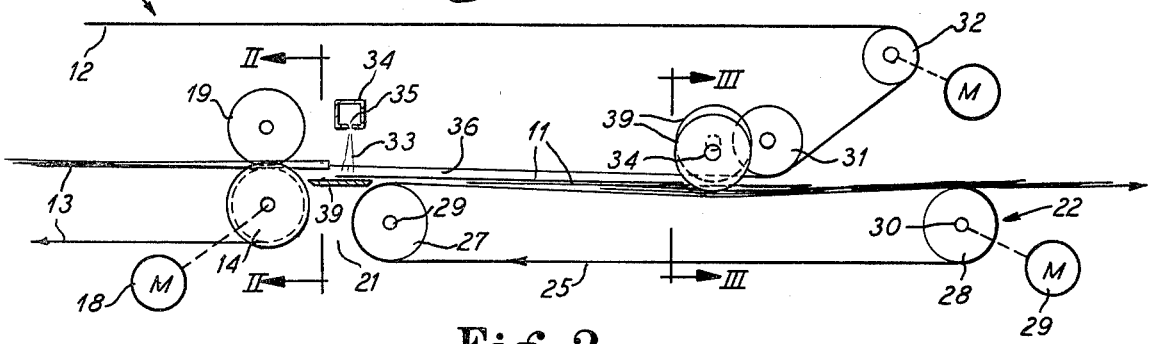
FIG. 1 is a schematic side elevational view of apparatus embodying the invention.

The method of the present invention will be best understood as related to apparatus 10 especially adapted to practice the method. Although the apparatus 10 may be adapted for handling individual paper sheets 11 to be stacked, in a preferred arrangement, a plurality of the sheets 11 in side by side separated relation are adapted to be handled simultaneously. As is customary, the sheets 11 are separated by means of any suitable shearing device (not shown) from a continuously advancing paper web, and either before or after shearing separation from the web, the separated portion or sheets of the web are slit longitudinally for separation into individual side by side strips or sheets. Whether narrow strips or wider strips, all of the side by side separated web sections will hereinafter be referred to as sheets, in other words, the sheets 11 as depicted in the drawing.

After shearing and slitting, the sheets 11 are transported at high speed between cooperating upper and lower high speed conveyor tapes or belts 12 and 13, respectively. In a preferred arrangement, at least a pair of the conveyor belts 12 cooperates with a corresponding pair of the conveyor belts 13 to grip each of the sheets 11. As best visualized in FIG. 2, the cooperating sheet gripping conveyor belts 12 and 13 are spaced for substantially balanced gripping and advancing of the sheet 11. Each of the conveyor belts 12 and 13 is of the endless type trained over suitable roller means and maintained under desirable tension for the intended purpose, as is customary with endless flexible belt conveyors. The span or run of the corunning high speed conveyor belts 12 and 13 is at least sufficient to assure positive control for advancing the sheets 11 seriatim.

Figure 2:
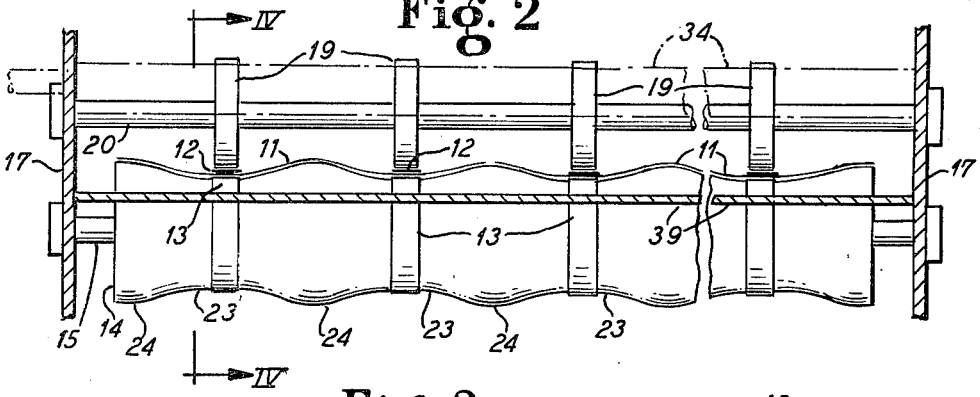
FIG. 2 is an enlarged fragmental vertical sectional elevational view taken substantially in the plane of line II—II of FIG. 1.

At the discharge end of the high speed conveyor provided by the belts 12 and 13, the lower belts 13 are trained about a roller 14 having a shaft 15 journal on machine frame structure 17. Means such as an electrical motor 18 may drive the roller 14 at the desired high speed rate. Although the roller 14 is depicted in FIG. 2 as continuous throughout its length, and which length may be sufficient to accommodate any desired plurality of strips or sheet 11 in side-by-side separated relation, the roller may for convenience be constructed as a plurality of shorter sections mounted coaxially on the shaft 15.

Cooperating with the roller 14 are roller means preferably comprising individual guiding, idler and pressure rollers 19 which engage the upper belts 12 and press the running belt and sheet assembly close to or against the roller 14. In a desirable arrangement, the rollers 19 are idlers and mounted on a shaft 20 suitably supported at its opposite ends on the frame structure 17. While the rollers 19 may be fixed corotatively with the shaft 20 and the shaft journaled at its opposite ends, the shaft 20 may be stationary and the rollers 19 rotatable on the shaft in their preferred axially spaced relation along the shaft, having regard to the width of the sheet 11 being handled in each instance.

Figure 4:
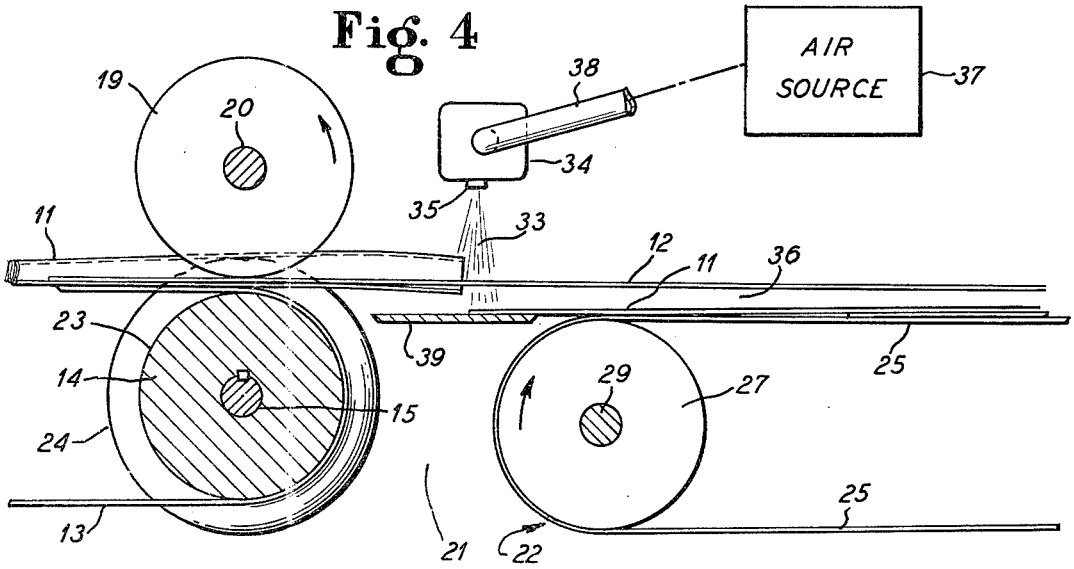
FIG. 4 is an enlarged fragmentary sectional detail view taken substantially along the line IV—IV of FIG. 2.

To facilitate advance of the sheets 11 across a gap 21 onto a slower speed conveyor 22 with which the upper high speed conveyor belts 12 cooperate to form a sheet controlling tunnel, means are provided for deflecting the sheets 11 into impermanent, wave-like longitudinal stiffening rib formation between the rollers 14 and 19, such rib deflection being sufficient to assure effective travel of the sheets 11 in relatively unsupported relation across the gap 21 without undesirable sagging, but without creasing or permanently corrugating the sheets so that ultimately the sheets can be stacked flat upon one another. To attain the temporary longitudinal stiffening rib deflection, the lower roll 14 is shaped with an undulating contour providing concave annular shallow grooves 23 alternating with annular convex ridges 24. The lower high speed conveyor belts 13 are engaged in the grooves 23 and thus the upper rollers 19 press the belts 12 down into the grooves 23 and thus press the intervening sheet 11 into the grooves 23, with the extent of the sheet 11 between the belts 12,13 engaging the roller ridges 24. Therefore, as the sheet 11 discharges from the high speed conveyor across the gap 21, the leading end of the sheet will maintain a longitudinal stiffening rib condition, as best seen in FIG. 4, long enough after leaving the nip of the rollers 14 and 19 to traverse the gap 21 in a substantially stable and sag resistant manner at least past the point of intersection of the trailing end of the preceding sheet. As the trailing end of the sheet leaves the belts 12 and 13, it flattens out and is no longer stiffened.

In a preferred arrangement, the slower speed conveyor 22 comprises a set of suitable laterally spaced endless conveyor tapes or belts 25 trained under tension at one end of the conveyor over guide roller means 27 adjacent to the gap 21. At the opposite end of the conveyor, the belts 25 are trained under tension over guide roller means 28 which may be driven as by means of a motor 29. Although the guide roller means 27 and 28 may be one continuous length, they may, if preferred, be constructed in coaxial sections. A shaft 29 for the roller means 27 and a shaft 30 for the roller means 28 may be suitably supported on the machine frame structure 17. In the preferred arrangement, the upper or sheet supporting runs of the conveyor belts 25 are at a lower elevation than the nip elevation for the rollers 14 and 19; at least at the receiving end of the conveyor 22, so as to facilitate reception of the successive sheets 11 thereon. The differential in elevation between the sheet engaging runs of the high speed and low speed conveyors may be on the order of a ¼ to 1 inch dropoff.

To facilitate delivery of the successive sheets 11 to and reception of the sheets on the slower speed conveyor 22, the upper high speed conveyor belts 12 extend beyond the dropoff point from the high speed conveyor at an elevation above the supporting run of the slower speed conveyor belts 25 to define a sheet-controlling tunnel 36 of at least a length as great as the length of the sheets 11. At the downstream end of the tunnel 36, the conveyor belts 12 are trained about idler roller means 31 and extend upwardly over driving roller means 32 to a return run to the starting point for the high speed conveyor.

As a further assist in transition of the sheets 11 from the high speed conveyor to the slower speed conveyor 22, means are provided for directing air 33 (FIGS. 1 and 4) downwardly through the tunnel forming extending high speed conveyor belts 12 at the gap 21 and downwardly onto the sheets 11 traversing the gap from the dropoff point defined by the lower high speed conveyor belts 13 toward and onto the slower speed conveyor 22. The air 33 is preferably directed at relatively low pressure but sufficient to deflect the leading end of each of the succeeding sheets 11 and then the body of the sheet slightly downwardly away from the overlying high speed conveyor belts 12. However, the stiffening ribs of the sheets 11 as they leave the high speed conveyor resist down curl or buckling from impingement by the air 33. Where there is a static electricity condition which may tend to resist separation of the sheets 11 from the belts 12, the air 33 should be ionized. Pressure of the ionized air 33 should be regulated to effect sufficient slight deflection of the advancing sheets 11 to promote separation of the sheets from the belts 12 sufficiently to assure sweeping of the ionized air not only over, but also under the belts 12 and over the entire upper surfaces of the sheets 11 for efficiently eliminating static electricity attraction between the paper sheets and the conveyor belts 12. At the same time, the air 33 has a downward pushing effect on the paper sheets away from the conveyor belts 12 as the sheets advance, to assure freedom from interference between the trailing end of each sheet as it is delivered to the slower speed conveyor 22 and the leading end of the next succeeding sheet. The moderate downward pressure assures downward deflection of the flattened, no longer stiffened trailing ends of the sheets 11 so that the next succeeding sheets can travel over the preceding sheet in each instance shingling overlapping to promote efficient stacking after discharge from the conveyor 22.

Delivery of the ionized air 33 is desirably effected by means of a hollow ionizing bar 34 having downwardly directed nozzle means 35 extending across the width of the conveyor system. Air is adapted to be supplied from a source 37 through a conduit 38 to the hollow ionizing and nozzle bar 34. To prevent undue sagging of the trailing ends of the sheets 11 after dropoff from the high speed conveyor and also to avoid any excessive downturn of the advancing ends of the sheets 11, a transition or bridging surface plate or baffle 39 is desirably mounted across the gap 21 and with the upper plane of the plate 39 aligned with the upper plane of the slower speed conveyor 22.

Figure 3:
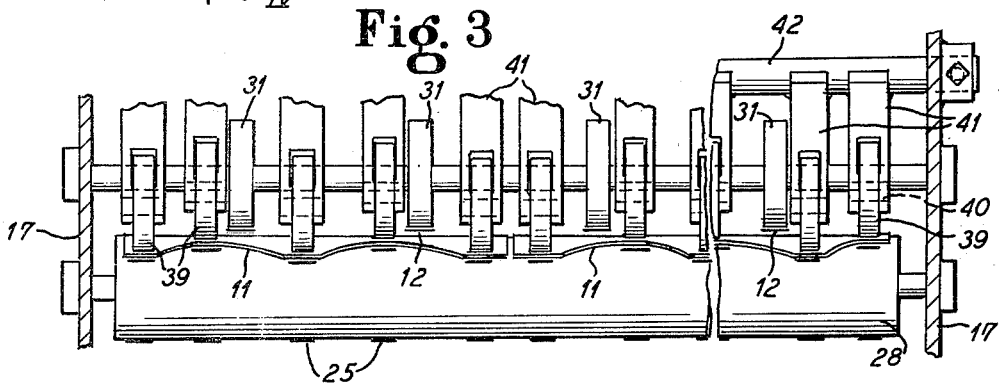
FIG. 3 is an enlarged fragmentary sectional elevational detail view taken substantially along the line III—III of FIG. 1.

Improved means are provided for stopping high speed advance of each successive sheet 11 after it has been fully received on the slower speed conveyor 22, whereby to cause the sheet in each instance to travel at the slower speed of the slower speed conveyor so as to receive thereon from the high speed conveyor belts 12 and 13 a succeeding sheet in superimposed shingling overlapping relation for stacking purposes. To this end, stop rollers 39 cooperate with the tensioned slower speed conveyor belts 25 at a sufficient distance downstream from the guide rollers 27 to engage with the leading end of each of the sheets 11 after it has fully left the high speed conveyor and extends onto the slower speed conveyor a sufficient distance to provide for the desired amount of overlap of the next succeeding sheet having regard to the speed differential of the two conveyors. Herein a separate one of the stop rollers 39 is provided for the upper tensioned active run of each of the slower speed conveyor belts 25. Conveniently, each of the stop rollers 39 may be a freely rotating idler roller rotating on a shaft 40 supported by means such as a yoke 41 mounted on a supporting bar or beam 42 carried by the frame structure 17. For improved functioning of the stop roller means, the rollers 39 are desirably alternately staggered in thrusting relation to the conveyor belts 25 so that certain of the rollers 39 project to a lower elevation than intervening ones of the rollers 39 whereby to effect impermanent wave-like longitudinal jam preventing stiffening rib deflection of the sheets 11 substantially as shown in FIG. 3. Thereby, the sheet 11 in each instance is adapted to assume a transverse shallow wavy deflected configuration which efficiently avoids up curl or down curl at the leading end of each sheet as it reaches the stop rollers 39. At the stop rollers 39, the speed of travel of the sheet 11 is conformed to the differential slower speed of the lower conveyor 22 as compared to the higher speed of the high speed conveyor to assure effective overlap of the next succeeding sheet in each instance onto the sheet which has already been received on the slower speed conveyor. It will be observed that a plurality of the rollers 39, in suitably axially spaced relation to one another is provided for each of the sheets 11, depending upon the width of the sheet.

Efficiency is improved by having the upper high speed belts converge at the downstream end of the tunnel 36, that is the end of the tunnel adjacent to the stop rollers 39 to a minimum gap, but at a sufficient elevation to avoid direct contact with the sheets 11 carried by the slower speed conveyor 22. For example, although at the upstream end of the tunnel 36, the gap between the high speed belts 12 and the slower speed conveyor belts 25 may be from $\frac{1}{4}$ to 1 inch, at the downstream end of the tunnel the gap may be only from $\frac{1}{8}$ to $\frac{1}{4}$ inch. Efficient guiding of the successive sheets into the nip of the stop wheels or rollers 39 is thereby attained.

As shown (FIGS. 1 and 3), the high speed conveyor belts 12 conveniently extend through gaps between certain of the stop rollers 39 to the guide rollers 31.

Beyond the stop rollers 39, the overlapped sheets travel with the conveyor 22 to a stacker (not shown) in which stacking is effected in any suitable or preferred manner, and wherein the shingle lapped sheets 11 will be properly coextensively aligned in stacked relation.

It will be understood that variations and modifications may be effected without departing from the spirit and scope of the novel concepts of this invention.

I claim as my invention:

1. A method of handling paper sheets to be stacked, comprising:

advancing the sheets seriatim gripped between upper and lower corunning high speed conveyor belts in which said lower belts leave the advancing ends of the sheets at a predetermined point while said upper high speed conveyor belts extend a substantial distance beyond said point into sheet controlling tunnel relation over a slower speed multi-belt conveyor;

propelling the sheets across a gap from said lower high speed conveyor belts toward and onto said slower speed conveyor;

and after each successive sheet has been fully received on said slower speed conveyor stopping high speed advance of the sheet and effecting impermanent wave-like longitudinal jam preventing stiffening rib deflection of the sheet and causing the sheet to travel with the slower speed conveyor so as to receive from said high speed conveyor belts a succeeding sheet in superimposed overlapping relation for stacking purposes.

2. A method according to claim 1, comprising effecting said stiffening rib deflection of the successive sheets by pressing stop rollers against alternate ones of the belts of the slower speed conveyor to deflect said alternate belts below the other belts of the slower speed multi-belt conveyor.

3. A method according to claim 1, including directing ionized air downwardly through said upper high speed conveyor belts at said gap and downwardly onto the paper sheets traversing said gap and thereby eliminating static electricity attraction between the paper sheets and said upper conveyor belts and also pushing the paper sheets downwardly away from said upper conveyor belts whereby to assure freedom from interference between the trailing end of each sheet as it is delivered to the slower speed conveyor and the leading end of the next succeeding sheet.

4. In a method of handling paper sheets to be stacked, including continuously advancing the sheets seriatim gripped between upper and lower corunning high speed conveyor belts in which said lower belts leave the advancing ends of the sheets at a predetermined point while said upper high speed conveyor belts extend a substantial distance beyond said point into sheet controlling tunnel relation over a slower speed conveyor on which the sheets are received across a gap from said lower speed conveyor belts for slowdown and stacking purposes, the improvement comprising:

effecting impermanent wave-like longitudinal stiffening rib deflection of the sheets as they enter said gap so that said sheets will advance across said gap onto said slow speed conveyor without buckling;

propelling each rib-stiffened sheets across said gap from said lower high speed conveyor belts toward and onto said slower speed conveyor;

continuously directing ionized air downwardly through said upper high speed conveyor belts at said gap and downwardly onto each advancing paper sheet traversing said gap and thereby eliminating static electricity attraction between the paper and said upper conveyor belts and also continuously biasing the paper sheet downwardly away from said upper conveyor belts;

releasing the trailing end of each sheet as it enters said gap from said stiffening rib deflections so that the trailing end returns toward the original plane of the sheet;

by the continuous biasing effect of said continuously directed ionized air pushing said trailing end downwardly in said gap away from the lower high speed belts and thereby assuring freedom from interference by said trailing end with the leading impermanently rib-stiffened end of the next succeeding sheet;

and as each successive sheet is fully received on said slower speed conveyor stopping high speed advance of the sheet and effecting impermanent wave-like longitudinal jam preventing stiffening rib deflection of the sheet and causing the sheet to travel with the slower speed conveyor so as to enable receiving from said high speed conveyor belts a next succeeding sheet in superimposed overlapping relation for slowdown and stacking purposes.

5. A method according to claim 4, including supporting the trailing ends of said sheets against dropping in said gap substantially below the top of said slower speed conveyor.

6. A method according to claim 4, comprising directing said ionized air from a continuously ionizing device mounted adjacently above said upper high speed conveyor belts and in overlying relation to said gap.

7. In an apparatus for handling paper sheets to be stacked and including upper and lower corunning high speed conveyor belts for advancing the sheets seriatim gripped between said belts, said lower belts advancing with the sheets to a predetermined dropoff point and a slower speed conveyor extending in sheet receiving but gap relation from said dropoff point, and on which the sheets are received for slowdown and stacking purposes, said upper high speed conveyor belts extending beyond said dropoff point and into sheet controlling tunnel relation over said slower speed conveyor, the improvement comprising:

means for effecting impermanent wave-like longitudinal stiffening rib deflection of said sheets as the sheets enter said gap so that they will advance across said gap onto said slower speed conveyor without buckling;

said lower high speed conveyor belts releasing the trailing end of each sheet as the trailing end enters said gap and thereby releasing the trailing end portion of the sheet from said stiffening rib deflection means so that the trailing end returns toward the original plane of the sheet;

means for continuously directing ionized air downwardly onto and through said upper high speed conveyor belts at said gap and downwardly onto each advancing paper sheet traversing said gap from said dropoff point toward and onto said slower speed conveyor, and thereby eliminating static electricity attraction between the paper sheets and said upper conveyor belts and also continuously biasing the paper sheets downwardly away from said upper conveyor belts, the continuously biasing effect of said continuously directed ionized air from said directing means pushing the trailing end of each advancing sheet, as it enters said gap, away from said drop off point, thereby assuring freedom from interference by said trailing end with the impermanently rib-stiffened leading end of the next succeeding sheet;

and means for stopping high speed advance of each successive sheet as it is fully received on said slower speed conveyor and for at the same time effecting impermanent wave-like longitudinal jam preventing stiffening rib deflection of each sheet so that each sheet is caused to travel with the slower speed conveyor so as to enable receiving thereon from said high speed conveyor belts a next succeeding sheet in superimposed overlapping relation for slowdown and stacking purposes.

8. Apparatus according to claim 7, wherein said means for continuously directing ionized air comprises a device mounted adjacently above said upper high speed conveyor belts and in overlying relation to said gap.

9. Apparatus according to claim 7, wherein said slower speed conveyor comprises spaced longitudinally running belts, said means for stopping high speed advance of each successive sheet comprise individual rollers thrusting downwardly against said slower speed conveyor belts, and said means for stiffening rib deflection of the sheets in coordinated relation with operation of said means for stopping high speed advance of the sheets comprising alternate ones of said sheet stopping rollers thrusting the slower speed conveyor belts to a lower elevation than the remaining stopping rollers thrust the remaining slower speed conveyor belts.

10. Apparatus according to claim 7, including means for supporting the trailing end of said sheets against dropping in said gap substantially below the top of said slower speed conveyor.

11. Apparatus for handling paper sheets to be stacked, comprising:

upper and lower corunning high speed conveyor belts for advancing the sheets seriatim gripped between said belts;

said lower belts advancing with the sheets to a predetermined dropoff point;

a slower speed multi-belt conveyor extending in sheet receiving but gap relation from said dropoff point;

said upper high speed conveyor belts extending beyond said dropoff point and into sheet controlling tunnel relation over said slower speed conveyor;

and means for stopping high speed advance of each successive sheet after it has been fully received on said slower speed conveyor and for effecting impermanent wave-like longitudinal jam preventing stiffening rib deflection of said sheets and for causing such sheet to travel with the slower speed conveyor so as to receive thereon from said high speed conveyor belts a succeeding sheet in superimposed overlapping relation for stacking purposes.

12. Apparatus according to claim 11, wherein said means for stopping and effecting said stiffening rib deflection of the successive sheet comprises stop rollers pressing against alternate ones of the belts of said slower speed conveyor and deflecting said alternate belts below other belts of the slower speed conveyor.

13. Apparatus according to claim 11, including means for directing ionized air downwardly through said extending upper high speed conveyor belts at said gap and downwardly onto the paper sheets traversing said gap from said dropoff point toward and onto said slower speed conveyor and thereby eliminating static electricity attraction between the paper sheets and said upper conveyor belts and also pushing the paper sheets downwardly away from said upper conveyor belts whereby to assure freedom from interference between the trailing end of each sheet as it is delivered to the slower speed conveyor and the leading end of the next succeeding sheet.

14. A method of handling paper sheets to be stacked, comprising:

advancing the sheets seriatim gripped between upper and lower corunning high speed conveyor belts in which said lower belts leave the advancing ends of the sheet at a predetermined point while said upper high speed conveyor belts extend a substantial distance beyond said point into sheet controlling tunnel relation over a slower speed conveyor on which the sheets are received for slowdown and stacking purposes;

propelling the sheets across a gap from said lower high speed conveyor belts toward and onto said slower speed conveyor;

effecting impermanent wave-like longitudinal stiffening rib deflection of the sheets before they enter said gap, whereby to facilitate advance of the leading ends of the sheets across said gap in a stable and sag resistant manner at least beyond the point of overlap with respect to the trailing ends of the next preceding sheets on said slower speed conveyor;

directing air downwardly through said upper high speed conveyor belts at said gap and downwardly onto the sheets traversing said gap and pushing the trailing ends of the paper sheets after release from said upper conveyor belts downwardly relative to said dropoff point whereby to assure freedom from interference between the trailing end of each sheet as it is delivered to the slower speed conveyor and the leading end of the next succeeding sheet;

and as each successive sheet is fully received on said slower speed conveyor stopping high speed advance of the sheet and effecting impermanent wave-like longitudinal jam preventing stiffening rib deflection of the sheets and causing the sheet to travel with the slower speed conveyor for reception from said high speed conveyor belts a succeeding sheet in superimposed overlapping relation for slowdown and stacking purposes.

15. A method according to claim 14, which comprises ionizing said air for eliminating static electricity attraction between the paper sheets and said upper conveyor belts.

16. Apparatus for handling paper sheets to be stacked, comprising:

upper and lower corunning high speed conveyor belts for advancing the sheets seriatim gripped between said belts;

said lower belts advancing with the sheets to a predetermined dropoff point;

a slower speed conveyor extending in sheet receiving but gap relation from said dropoff point, and on which the sheets are received for slowdown and stacking purposes;

said upper high speed conveyor belts extending beyond said dropoff point and into sheet controlling tunnel relation over said slower speed conveyor;

means for effecting impermanent wave-like longitudinal stiffening rib deflection of the sheet before they enter said gap, whereby to facilitate advance of the leading ends of the sheets across said gap in a stable and sag resistant manner at least beyond the point of overlap with respect to the trailing ends of the next preceding sheets on said slower speed conveyor;

means for continuously directing air downwardly through said upper high speed conveyor belts at said gap and downwardly onto the sheets traversing said gap for pushing the trailing ends of the paper sheets after release from said upper conveyor belts downwardly relative to said dropoff point to assure freedom from interference between the trailing end of each sheet as it is delivered to the slower speed conveyor and the leading end of the next succeeding sheet;

and means for (1) stopping high speed advance of each successive sheet as it is fully received on said slower speed conveyor and (2) for effecting impermanent wave-like longitudinal jam preventing stiffening rib deflection of the sheets and (3) for causing the sheet to travel with the slower speed conveyor for reception from said high speed conveyor belts a succeeding sheet in superimposed overlapping relation for slowdown and stacking purposes.

17. Apparatus according to claim 16, comprising means for ionizing said air for eliminating static electricity attraction between the paper sheets and said upper conveyor belts.

* * * * *